United States Patent [19]

Bivens

[11] 4,096,023

[45] Jun. 20, 1978

[54] LENS SEALING CLAMP

[76] Inventor: Carl F. Bivens, 810 E. 26th St., Des Moines, Iowa 50317

[21] Appl. No.: 683,764

[22] Filed: May 6, 1976

[51] Int. Cl.[2] ..... B25B 5/14; B30B 1/20

[52] U.S. Cl. ..... 156/580; 100/290; 156/563; 269/104; 269/134; 269/240; 269/308; 269/319

[58] Field of Search ..... 156/99, 100, 103, 106, 156/107, 563, 580, 581, 583, 557, 288, 537, 559, 560; 51/216 LP, 216 P, 217 P, 217 L; 65/37, 38; 240/151; 269/104, 134, 240, 271, 308, 319, 27, 265; 100/289-290, 208-209, DIG. 13

[56] References Cited

U.S. PATENT DOCUMENTS

| | | | |
|---|---|---|---|
| 574,404 | 1/1897 | Du Brul | 100/290 |
| 695,902 | 3/1902 | Bowker et al. | 51/217 L |
| 2,066,936 | 1/1937 | Jahraus | 156/583 |
| 2,618,302 | 11/1952 | Rockola | 269/27 |
| 2,708,400 | 5/1955 | Tait | 100/289 |
| 2,958,162 | 11/1960 | Upton | 65/38 |
| 3,356,360 | 12/1967 | Ward | 156/563 |

FOREIGN PATENT DOCUMENTS

| | | | |
|---|---|---|---|
| 458,447 | 3/1975 | U.S.S.R. | 156/580 |

*Primary Examiner*—David Klein
*Assistant Examiner*—M. G. Wityshyn
*Attorney, Agent, or Firm*—Henderson, Strom & Sturm

[57] ABSTRACT

A support assembly including elongated upper and lower parallel plates. A plurality of column supports separate and interconnect the parallel plates. A clamping assembly is supported by the plates, the clamping assembly having vertical and horizontal pressure screw assemblies. A vertical pressure screw assembly is mounted upon the upper plate adjacent each end thereof, and a horizontal pressure screw assembly is mounted upon the lower plate at each end thereof. Both vertical and horizontal pressure screw assemblies project into the space between the upper and lower plates. An annular flexible platform is attached to the lower plate adjacent each end thereof, beneath each vertical pressure screw assembly, and projects into the space between the plates. Lenses, which are to be fixed together by adhesive means to form a combination lens, are received upon a flexible platform, aligned by action of a horizontal pressure screw assembly, and pressed together by action of a vertical pressure screw assembly. A utility rack for holding individual lenses prior to assembly into a combination lens is attached to the support assembly.

7 Claims, 6 Drawing Figures

LENS SEALING CLAMP

BACKGROUND OF THE INVENTION

This invention relates to devices which are used in making and operating upon optical lenses. More particularly this invention comprises a structure for holding individual lenses and for clamping a plurality of lenses to aid in the construction of a combination lens for ophthalmic uses. The manufacture of an ophthalmic lens such as shown in applicant's U.S. Pat. No. 3,771,858 can be difficult, requiring a number of different clamping devices.

SUMMARY OF THE INVENTION

An optical lens clamping apparatus includes a first support assembly. The first support assembly includes parallel upper and lower plates which are spaced apart and interconnected by a plurality of support columns. Apertures are formed through the upper plate, one adjacent each end of the upper plate. Annular flexible platforms are attached to the lower plate, one adjacent each end of the lower plate, and project into the space between the plates. Each annular flexible platform is beneath an aperture and in axial alignment therewith.

A clamping assembly is attached to the first support assembly and includes vertical and horizontal pressure screws. The vertical pressure screws are threaded through the apertures in the upper plate and project into the space between the upper and lower plates. Horizontal pressure screws are supported at each end of the lower plate and are directed into the space between the plates.

A second support assembly is attached to the first support assembly. The second support assembly includes a shank member transversely affixed to the lower plate intermediate the ends thereof and a cross member affixed normal to the shank member.

Individual lenses, prior to assembly into a multifocal combination lens, are supported by the second support assembly. The lenses are removed therefrom and, after appropriate adhesive means have been applied to the lenses, are placed upon an annular flexible platform. The lenses are aligned on the platform by the horizontal pressure screw and are thereafter pressed together by the vertical pressure screw.

It is an object of this invention to provide an optical lens clamping apparatus which facilitates the manufacture of multifocal combination lenses.

It is another object of this invention to provide an optical lens clamping apparatus whereby two multifocal combination lenses may be fabricated simultaneously.

Another object of this invention is to provide an optical lens clamping apparatus that is operable within an air-evacuation box having insulator-type arm sleeves.

Still another object of this invention is to provide an optical lens clamping apparatus which safely supports a plurality of individual lenses prior to assembly into a combination lens.

A further object of this invention is to provide an optical lens clamping apparatus which may be used with lenses of a plurality of different diameters and types.

Yet a further object of this invention is to provide an optical lens clamping apparatus which the operator thereof may conveniently reach and operate with either the left or right hand, which provides for each placement therein of the individual lenses, and which provides ready access to the lenses during sealing into a combination lens and to the combination lens for removal therefrom after sealing is accomplished.

These objects and other features and advantages of the optical lens clamping apparatus of this invention will become readily apparent upon referring to the following description, when taken in conjunction with the appended drawing.

BRIEF DESCRIPTION OF THE DRAWING

The optical lens clamping apparatus of this invention is illustrated in the drawing wherein.

DESCRIPTION OF THE PREFERRED EMBODIMENT

Figure 1:
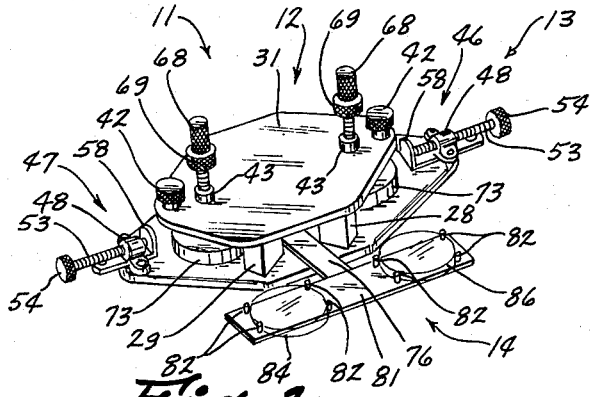
FIG. 1 is a perspective view of the optical lens clamping apparatus showing two individual lenses being supported prior to assembly into a combination lens.

Referring now to the drawings, the optical lens clamping apparatus of this invention is indicated generally at 11 in FIG. 1. The apparatus 11 more particularly includes a first support assembly 12, a clamping assembly 13 and a second support assembly 14.

Figure 4:
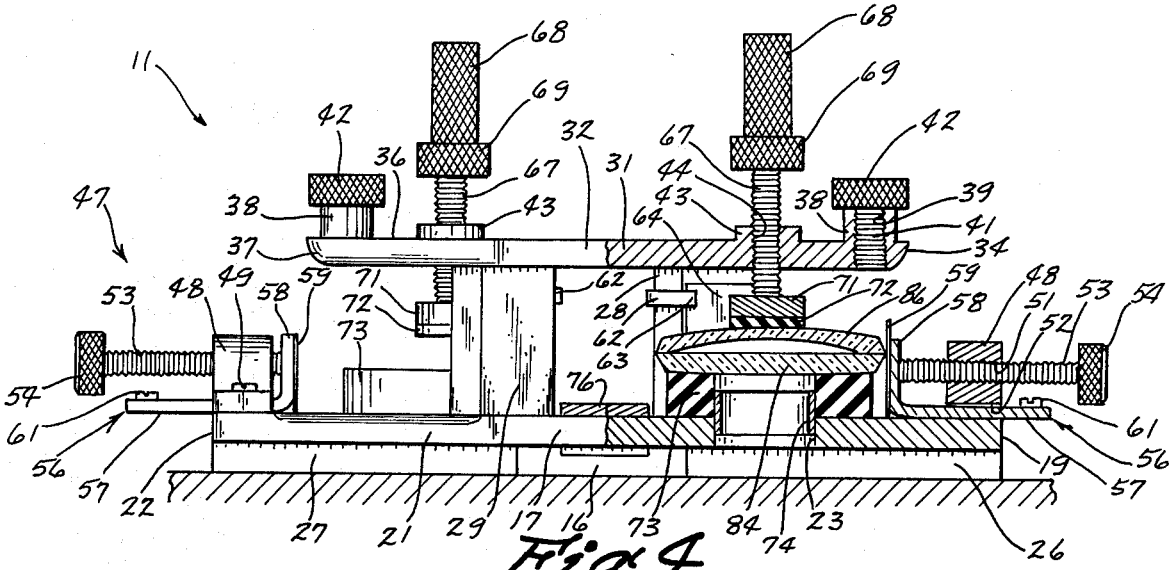
FIG. 4 is a view taken along line 4—4 in FIG. 3 showing the right half of the optical lens clamping apparatus in longitudinal section, the left half thereof in elevation, and part of the second support assembly completely cut away for greater clarity.
Figure 5:
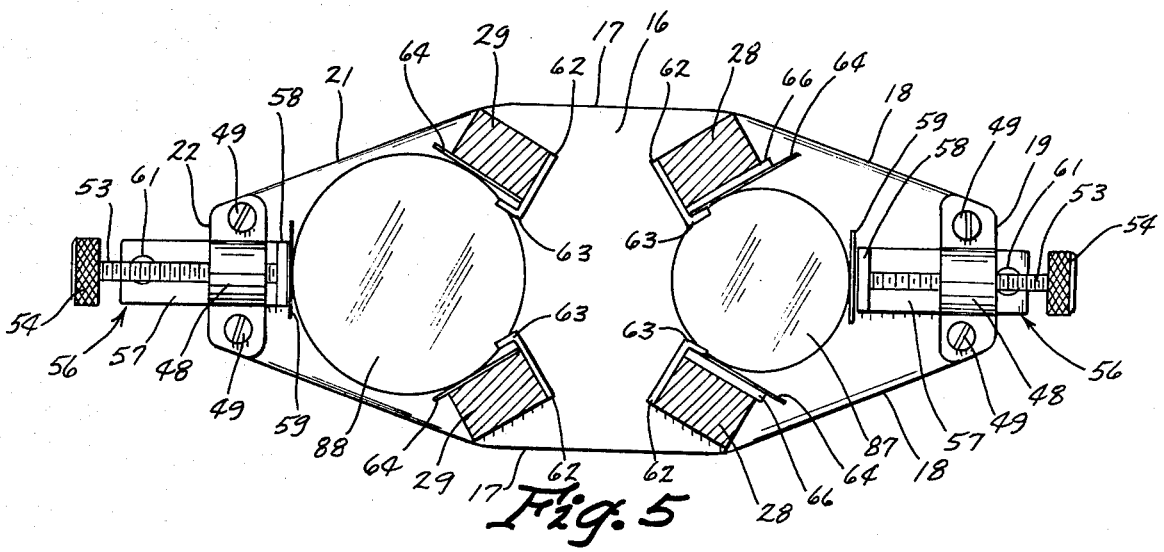
FIG. 5 is an enlarged, top plan view of the optical lens clamping apparatus, the upper plate being cut away to reveal a modification of the apparatus.

The first support assembly 12 (FIGS. 3, 4 and 5) includes a lower base platform or plate 16, shown most clearly in FIG. 5. The lower plate 16 has parallel longitudinal edges 17. Right beveled edges 18 are contiguous with the edges 17 and are joined by a right transverse edge 19 to form a beveled or tapered right end. Similarly, left beveled edges 21 are contiguous with the edges 17 and are joined by a left transverse edge 22 to form a tapered left end. The plate 16 has right and left apertures 23, 24 (FIGS. 3 and 4) formed therethrough and aligned along the longitudinal axis thereof. The plate 16 has bilateral symmetry about a transverse plane intersecting the plate 16 intermediate the edges 19, 22.

The lower plate 16 (FIG. 4) has right and left pairs of elongated support members 26, 27 depending therefrom which engage the table top or workbench. The sectional view of the right half of the optical lens clamping apparatus 11 in FIG. 4 has cut away one of the right pair of support members 26. The lower plate 16 (FIGS. 3 and 5) also has affixed normal thereto right and left pairs of support columns 28, 29. The columns 28, 29 are rectangular in cross section. The individual columns in both of the pairs 28, 29 are angularly disposed with respect to each other such that a V-shaped guide channel is defined opening outwardly toward the edge 19 or 22 respectively.

The first support assembly 12 also includes an upper platform or plate 31 (FIGS. 3 and 4) affixed normal to the columns 28, 29. The columns 28, 29 hold the plates 16, 31 in parallel and spaced apart relationship. The plate 31 includes parallel longitudinal edges 32. Right beveled edges 33 continue from the edges 32 and are joined by a rounded edge 34. Left beveled edges 36 continue from the edges 32 and are joined by a rounded edge 37. First raised annular reinforcements 38 are formed on the plate 31 adjacent the edges 34, 37. Threaded apertures 39 are formed through the reinforcements 38 and plate 31. Screws 41 having knurled heads 42 are threaded into the apertures 39. Disposed inwardly from the reinforcements 38 are second raised annular reinforcements 43 having threaded apertures 44 formed therethrough and through the plate 31.

The reinforcements 38, 43 and apertures 39, 44 are aligned along the longitudinal axis of the plate 31. The plate 31 is bisected by and has bilateral symmetry about the transverse plane which intersects the plate 16 intermediate the edges 19, 22, the plate 31 having a more pronounced tapering to the ends thereof than the plate 16. Each of the apertures 44 is axially aligned with the aperture 23 or 24.

Figure 3:
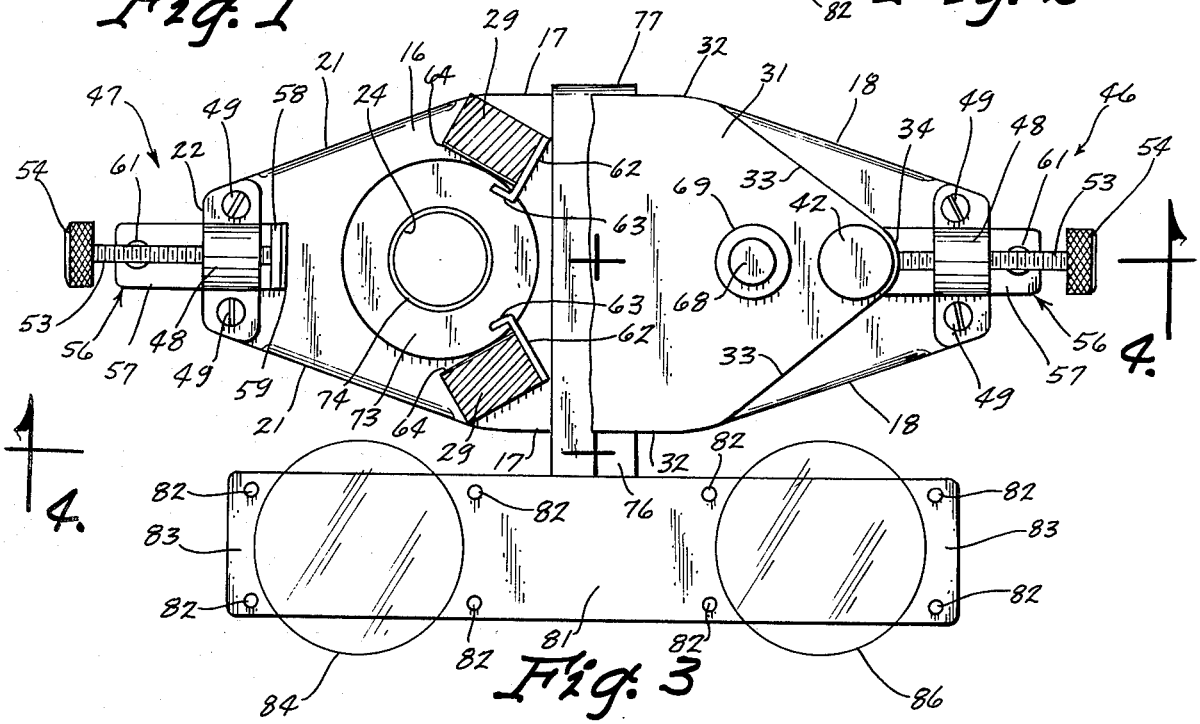
FIG. 3 is an enlarged, top plan view of the optical lens clamping apparatus, the left half of the upper plate being cut away to show underlying structures.

The clamping assembly 13 is attached to the first support assembly 12 and includes right and left clamping units 46, 47 (FIGS. 1, 3 and 4). Each of the clamping units 46, 47 includes an anchoring bracket 48 affixed to the lower plate 16, as with screws 49, adjacent the edge 19 or 22. The anchoring bracket 48 has a horizontally disposed threaded aperture 51 formed therethrough and a horizontally disposed groove 52 formed thereon below the aperture 51 and adjacent the plate 16 to form a slot. A horizontal pressure screw 53 having a knurled knob 54 is threaded through the aperture 51 and toward the space between the plates 16, 31. A slide bracket 56 has an elongated portion 57 and an angle portion 58 upturned therefrom at 90°. The portion 57 is slidably received by the groove 52, and the portion 58 on one side thereof abuts the end of the screw 53 and on the opposite side thereof bears an attached rubber pad or contact face 59. A stop screw 61 is affixed to the end of the portion 57 opposite the portion 58, thereby preventing the slide bracket 56 from disengaging from the anchoring bracket 58. The foregoing structure forms the horizontal pressure screw assembly of a clamping unit 46 or 47 of the clamping assembly 13.

Each of the clamping units 46, 47 (FIGS. 3 and 4) also includes a plurality of brackets 62 having short angle members 63. Each bracket 62 is affixed to a narrow face of a column 28 or 29, the member 63 thereof being disposed in front of and parallel to the inwardly directed wide faces of the columns 28, 29. Sheets of paper 64 are held by the brackets 62. Plate-like blocking members 66 (FIG. 5) of variable cross-sectional thicknesses may be disposed between the sheets 64 and the columns 28, 29.

Each of the clamping units 46, 47 (FIGS. 3 and 4) further includes structure which forms a vertical pressure screw assembly. A vertically disposed pressure screw 67, having at one end thereof small and large diameter knurled knobs 68, 69 attached, is threaded through the aperture 44. The vertical pressure screw 67 projects downwardly into the space between the plates 16, 31 and has affixed normal to the downwardly projected end thereof a pressure screw head 71. A flexible pressure pad 72 is affixed to the downwardly disposed side of the head 71.

Each of the clamping units 46, 47 additionally includes an annular, stationary flexible lens pad 73 affixed to the plate 16. An annular support sleeve 74 is affixed to the wall of the aperture 23 or 24. The sleeve 74 projects upward and out of the aperture 23 or 24 and presses against the inside wall of the pad 73. The apertures 23, 44, pressure screw 67, annular lens pad 73 and annular sleeve 74 all have a common vertical axis.

Figure 2:
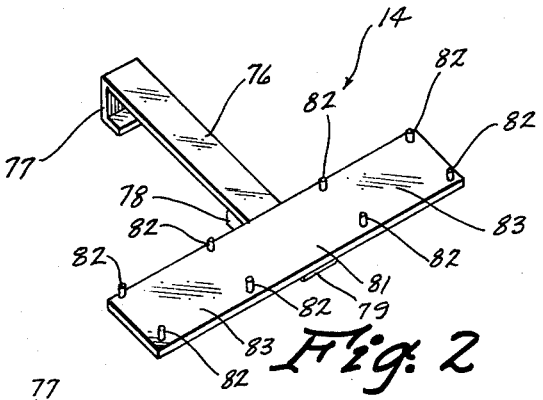
FIG. 2 is an enlarged, perspective view of the second support assembly of the optical lens clamping apparatus.

The second support assembly 14 is best illustrated in FIGS. 2 and 3. The assembly 14 includes an elongated, flat shank 76 having at one end thereof a continuously formed, downwardly curved hook 77. The shank 76 has a stop block 78 affixed to the underside thereof adjacent the opposite end 79. An elongated, flat cross member 81 is affixed normal to the shank 76 adjacent the end 79. Studs or rivets 82 are perpendicularly affixed to the member 81 and extend upwardly therefrom. The studs 82 define support areas 83 upon the cross member 81. As shown in FIGS. 3 and 4, the second support assembly 14 is attached to the lower plate 16. The hook 77 fits over one edge 17 of the plate 16, and the shank 76 rests transversely upon the plate 16, bisecting the plate 16. The stop 78, by engagement with the opposite edge 17, prevents the hook 77, and therefore the second support assembly 14 from disengaging from the plate 16.

When the optical lens clamping apparatus 11 is used, lenses 84, 86 which are to be assembled into a combination lens are held by the second support assembly 14. The lenses 84, 86, as shown in FIGS. 1 and 3, rest upon the support areas 83 and are secured thereon by the studs 82. A suitable adhesive means (not shown) is applied to the periphery of one side of lens 84 (illustrated in FIG. 4 as a plano-convex lens with the adhesive having been applied about the periphery of the planar side thereof). The lens 84 is then moved to the annular lens pad 73, the side of the lens 84 bearing adhesive facing upward. Adhesive is applied to the periphery of one side of the lens 86 (illustrated in FIG. 4 as a meniscus lens with the adhesive having been placed about the periphery of the concave side thereof), and the lens 86 is placed upon the lens 84, the side of lens 86 bearing adhesive facing downward and against the side of lens 84 bearing adhesive.

The horizontal pressure screw assembly of the clamping unit 46 or 47 is actuated. The operator (not shown) with his hand grasps the knob 54 and threads the screw 53 further into the space between the plates 16, 31. The screw 53, pressing against the portion 58, moves the slide bracket 56 inwardly. The flexible pad 59 pushes against the lenses 84, 86 (FIG. 4), and the lenses 84, 86 move over the annular pad 73, down the V-shaped guide channel, and against the sheets 64 and inwardly facing wide faces of the pair of columns 28 or 29. The screw 53 is tightened to a snug fit, and the lenses 84, 86 are properly positioned thereby such that the peripheries of the lenses 84, 86 precisely abut. The pad 59 and columns 28 or 29 form a collect-type support for the lenses 84, 86.

The vertical pressure screw assembly of the clamping unit 46 or 47 is next actuated. The operator grasps the large knob 69 and threads the screw 67 further into the space between the plates 16, 31. The flexible pressure pad 72 is pressed against the upper lens 86, and the lenses 84, 86 are pressed snugly against the flexible annular pad 73.

Once the lenses 84, 86 have been secured within a clamping unit 46 or 47, the adhesive is allowed to dry. The papers 64 keep the columns 28 or 29 from adhering to the lenses 84, 86, and similar papers may be used to ensure that the lenses 84, 86 do not stick to the pad 59. After the adhesive has dried, first the knob 69 is grasped, and the vertical screw 67 is loosened. The knob 68 is then grasped and the vertical screw 67 and pressure pad 72 rapidly threaded away from the newly made combination lens. The horizontal screw 53 is then loosened and the slide bracket 56 moved away from the combination lens. The operator then removes the lens.

As shown in FIG. 5, the use of blocking members 66 allows lenses 87 having a smaller diameter to be properly aligned and joined. Lenses 88 having a somewhat larger diameter can also be accommodated by the optical lens clamping apparatus 11.

Figure 6:
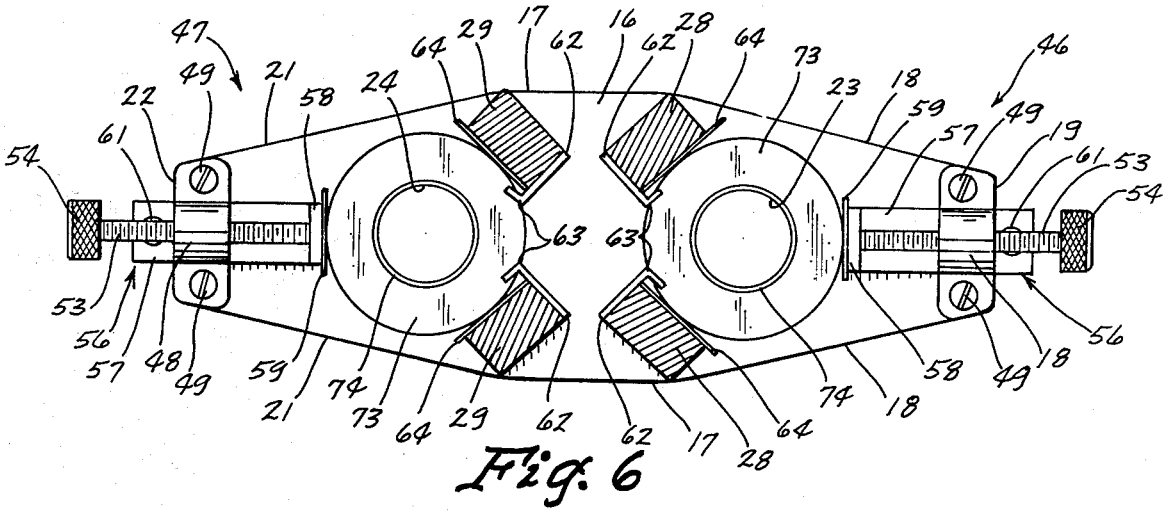
FIG. 6 is an enlarged, top plan view of the optical lens clamping apparatus, the upper plate being cut away, showing an alternate embodiment of the apparatus.

As shown in FIGS. 1–5, the columns 28 or 29 and the portion 58 with pad 59 are spaced about 120° apart about a lens which is clamped in the unit 46 or 47. An alternate embodiment of the apparatus 11 is shown in FIG. 6 wherein the columns 28 or 29 are spaced about 96° apart. A wider spacing such as this provides for greater accessibility to the lenses 84, 86, 87, 88 mounted or clamped within the units 46 or 47.

The optical lens clamping apparatus 11 eliminates the need for using several discrete clamps to hold lenses together and thereby facilitates the manufacture of combination lenses. Since both units 46 and 47 are available, two combination lenses may be made at the same time. The apparatus 11 may easily be used within an air-evacuation box having insulator-type arm sleeves. Lenses 84, 86, 87, 88 are safely and securely supported upon second support assembly 14 until assembled into a combination lens, and therefore other structures are no longer required to support lenses up off the work bench until needed. Lenses 84, 86, 87, 88 of different types and diameters may be joined using the apparatus 11. The areas 73, 83 are readily accessible by the operator with either hand. The apparatus 11 is readily portable by grasping the heads 42. Thus it can be seen that the objects of this invention have been attained.

Although a preferred embodiment of the optical lens clamping apparatus of this invention, and an alternate embodiment thereof, have been disclosed herein, it is to be remembered that various modifications and alternate constructions can be made thereto without departing from the full scope of the invention, as defined in the appended claims. For example, solid metal doll pins can be substituted for screws 49 and the horizontal pressure screw assemblies of units 46 and 47 can be removed after compression of the vertical pressure screw assemblies is completed.

I claim:

1. An optical lens clamping apparatus for use with a plurality of lenses and with adhesive material, said apparatus comprising:

first means for aligning the peripheral edges of a plurality of stacked lenses;

means for comprising a plurality of stacked lenses; and means for supporting said first means for aligning and said means for compressing, said means for supporting including upper and lower plates and second means for aligning the peripheral edges of a plurality of stacked lenses, said plates being interconnected and spaced apart by said second means for aligning, said means for compressing being affixed to said plates, the plurality of lenses being stacked within said means for compressing, said first means for aligning being affixed to said lower plate and first operating upon the stack of lenses, said means for compressing secondly operating upon the stack of lenses, whereby a plurality of stacked lenses having adhesive material placed adjacent the peripheral edges thereof are made to stick together; and further wherein said plates are parallel, said first means for aligning including a first pressure screw assembly being affixed to said lower plate and extending parallel to said plates, the lenses being stacked between said second means for aligning and said first pressure screw assembly, said first pressure screw assembly being extendable toward the peripheral edges of the stacked lenses, said second means for aligning receiving the peripheral edges of the stacked lenses thereagainst upon extension of said first pressure screw assembly against the lenses.

2. An optical lens clamping apparatus as defined in claim 1 and further wherein a second means for supporting a plurality of lenses is attached to said first means for supporting, said second means for supporting including a shank and a cross member, said shank having at one end thereof said cross member affixed thereto and at the opposite end thereof curving to form a hook, said hook engaging said first means for supporting, said shank resting upon said first means for supporting, said cross member being disposed adjacent said first means for supporting, said cross member having support areas formed thereon, lenses being removably received within said support areas.

3. An optical lens clamping apparatus as defined in claim 2 and further wherein said cross member has a plurality of rivets affixed thereto and upstanding therefrom, said rivets forming said support areas, the lenses within said support areas being held secure against movement therefrom by said rivets.

4. An optical lens clamping apparatus as defined in claim 1 and further wherein said means for compressing includes a support and a second pressure screw assembly, said support being attached to said lower plate, said second pressure screw assembly being attached to said upper plate, said second pressure screw assembly being extendable toward said support, the lenses being stacked upon said support and pressed against said support upon extension of said second pressure screw assembly.

5. An optical lens clamping apparatus as defined in claim 4 and further wherein said support includes a resilient first annular structure, a second annular structure and an aperture formed into said lower plate, said second annular structure fitting within said aperture and extending therefrom between said plates, said first annular structure fitting over said second annular structure, resting upon said lower plate and being disposed between said plates, said second pressure screw assembly, aperture, and first and second annular structures being aligned along an axis normal to said plates, the lenses being stacked upon said first annular structure.

6. An optical lens clamping apparatus as defined in claim 4 and further wherein said second means for aligning includes a plurality of columns, said columns connecting said plates and receiving the peripheral edges of the stacked lenses thereagainst, each column having a facing means removably disposed thereagainst whereby said column is shielded from direct contact with the lenses, each column having a blocking means removably disposed between said column and said facing means whereby lenses of different sizes are accommodated.

7. An optical lens clamping apparatus as defined in claim 1 and further wherein said second means for aligning includes a plurality of columns, each column interconnecting said plates, each column having a support bracket affixed thereto, a facing means and a blocking means, both said facing means and said blocking means being independently, removably held to said column by said support bracket.

* * * * *